US007156933B2

(12) United States Patent
Ebner et al.

(10) Patent No.: US 7,156,933 B2
(45) Date of Patent: Jan. 2, 2007

(54) CONFIGURATION AND METHOD FOR MOUNTING A BACKING FILM TO A POLISH HEAD

(75) Inventors: Katrin Ebner, Dresden (DE); David Erdmann, Dresden (DE); Walter Glashauser, Oberhaching (DE); Lutz Teichgräber, Moritzburg (DE)

(73) Assignee: Infineon Technologies SC 300 GmbH & Co. KG, Munich (DE)

( * ) Notice: Subject to any disclaimer, the term of this patent is extended or adjusted under 35 U.S.C. 154(b) by 306 days.

(21) Appl. No.: 10/462,422

(22) Filed: Jun. 16, 2003

(65) Prior Publication Data

US 2005/0075049 A1 Apr. 7, 2005

Related U.S. Application Data

(63) Continuation of application No. PCT/EP01/14806, filed on Dec. 14, 2001.

(51) Int. Cl.
*B32B 37/06* (2006.01)
*B32B 37/10* (2006.01)

(52) U.S. Cl. ..... 156/64; 156/299; 156/297; 156/351; 156/358; 156/583.1

(58) Field of Classification Search ..... 156/580, 156/360, 361, 359, 358, 351, 583.1, 64, 297, 156/299
See application file for complete search history.

(56) References Cited

U.S. PATENT DOCUMENTS 4,992,133 A * 2/1991 Border ..... 156/498
5,431,749 A * 7/1995 Messner ..... 156/358
5,573,448 A 11/1996 Nakazima et al.
6,074,288 A 6/2000 Nagahara et al.
6,095,900 A 8/2000 Fruitman et al.
2002/0081958 A1* 6/2002 Foster ..... 451/458

FOREIGN PATENT DOCUMENTS

| | | |
|---|---|---|
| JP | 4303582 | 10/1992 |
| JP | 5291217 | 11/1993 |
| JP | 11045867 | 2/1999 |
| JP | 11156708 | 6/1999 |
| JP | 2000202761 | 7/2000 |
| WO | 95/06544 | 3/1995 |
| WO | 00/12643 | 3/2000 |

* cited by examiner

*Primary Examiner*—George Koch
(74) *Attorney, Agent, or Firm*—Laurence A. Greenberg; Werner H. Stemer; Ralph E. Locher

(57) ABSTRACT

By applying heat and pressure to a backing film with an adhesive layer while mounting it to a polish head used for chemical mechanical polishing, inhomogeneities inside the adhesive layer, e.g. thickness and compressibility variations or air bubbles can easily be removed. A corresponding configuration includes a device for exerting a uniform pressure force, which can be a roller made of silicone or rubber, or a plate. The configuration also includes a device for heating and a control unit for controlling the heat and the pressure force. After the backing film is installed using this configuration and method, the polish head can be used to uniformly remove material from a semiconductor wafer surface and therefore the wafer yield is advantageously increased.

22 Claims, 6 Drawing Sheets

CONFIGURATION AND METHOD FOR MOUNTING A BACKING FILM TO A POLISH HEAD

CROSS-REFERENCE TO RELATED APPLICATION

This application is a continuation of copending International Application No. PCT/EP01/14806, filed Dec. 14, 2001, which designated the United States and was published in English.

BACKGROUND OF THE INVENTION

Field of the Invention

The present invention relates to a configuration and a method for mounting a backing film to a polish head. The polish head has a surface for contacting the backing film, and the backing film has an adhesive layer.

With the advent of smaller feature sizes below quarter micron in semiconductor wafer manufacturing, the process of chemical mechanical polishing (CMP) has become increasingly important to planarize newly deposited or grown layers and non-uniform surfaces on semiconductor devices, e.g. wafers. The semiconductor wafer to be polished is pressed to a pad, onto which a slurry is continuously conducted, and the pad, which is mounted on a polishing table, is moved relative to the wafer. The slurry distributed between the wafer and the pad contains abrasive with a size of typically 10–50 nanometers for mechanically removing material from the wafer surface, as well as active chemical additives, which provide a selective removal of material, e.g. tungsten.

The uniform removal of material from the wafer surface can be supported by mounting a backing film to the polish head on the backside of the wafer. In this case the wafer is held by the polish head to which the backing film is mounted. The wafer includes a system of vacuum holes connecting the wafer backside to a vacuum for holding the wafer prior to polishing. During polishing the wafer is commonly released from the vacuum holes. The backing film serves for damping and outweighing the tension of single abrasive particles exerted from beneath the wafer and for shielding against particles frictioning on the wafer backside. The wafer, when sucked to the polish head or when lying on the slurry and the pad below the polish head is surrounded by floating or fixed retaining rings for protecting the wafer edges against intenser abrasion as compared with the inner parts, thus providing a uniform polishing across the wafer. The polishing movement commonly includes a rotation of the polish head with the semiconductor wafer beneath around a first axis and a rotation of the table with the polish pad around a second axis.

Due to material fatigue caused, e.g., by particle contamination, the backing film has to be replaced with new material on a regular time basis. For most CMP apparatus this is performed by manually unmounting the polish head from the apparatus, removing the old backing film from the polish head and then manually sticking on a new backing film. Backing films consisting of e.g. polyurethane commonly have an adhesive layer on one of the surfaces thereof. The process of manually sticking on the backing film often involves the accidental enclosure of small air bubbles between the adhesive layer of the backing film and the backing plate, i.e. the polish head. These air bubbles lead to a located pressure on the wafer backside and therefore result in spots the wafer frontside, which are exposed relative to their surroundings. During polishing the removal of the wafer frontside surface material located in those exposed spots is rather intense and can lead to damage of the corresponding chip, thereby decreasing the yield significantly.

Moreover, the adhesive layer varies in material characteristics, e.g. thickness and compressibility across the backing film. These non-uniformities in the backing film directly influence the uniformity of removal of material from the semiconductor wafer surface as well. Since the mounting of backing films depends on the skills of the operators, the disadvantages are still increased. Monitoring the process in order to undertake corrections is rendered impossible in default of process reproducibility.

SUMMARY OF THE INVENTION

It is accordingly an object of the invention to provide a configuration and a method for mounting a backing film to a polish head, which overcomes the above-mentioned disadvantages of the prior art apparatus and methods of this general type.

In particular, it is a primary object of this invention to increase the yield in semiconductor wafer manufacturing by improving the quality of the chemical mechanical polishing process.

With the foregoing and other objects in view there is provided, in accordance with the invention, a configuration for mounting a backing film, which has an adhesive layer, on a polish head for polishing disklike objects. The configuration includes: a device for holding the polish head; a pressure exerting device for exerting a uniform pressure force on a surface of the polish head when the surface of the polish head is being covered by the backing film; and a device for heating the backing film. The pressure exerting device includes a roller having an axis parallel to the surface of the polish head. The pressure exerting device includes a roller guide for guiding the roller parallel to the surface of the polish head when the polish head is held by the device for holding the polish head.

With the foregoing and other objects in view there is provided, in accordance with the invention, a method for mounting a backing film having an adhesive layer. The method includes steps of: providing a polish head having a surface for contacting the backing film, the surface of the polish head formed with vacuum holes; holding the polish head; covering the surface of the polish head with the backing film; heating the backing film, while holding a heating temperature substantially constant or below a threshold value using a control unit and a temperature measuring sensor; and exerting a uniform pressure force on the backing film perpendicular to the surface of the polish head, when the polish head is being covered by the backing film.

Using the configuration and the method, the backing film including the adhesive layer is mounted to and stuck on the polish head by applying pressure and temperature to the backing film at the same time. Under the influence of temperature, the adhesive layer liquefies and can easily be redistributed between the backing film and the polish head by applying a pressure force onto the backing film. E.g., applying a uniform pressure force across the backing film surface, a uniform adhesive layer thickness emerges straightforwardly.

Moreover, the occurrence of air bubbles that are enclosed between the adhesive layer and the polish head can be significantly reduced by applying a locally dependent pressure force, that starts to act at some location on the backing film and moves continuously across the backing film such that air bubbles are continuously shifted until they reach the edge of the backing film, and thus eventually leave the adhesive layer. Another advantage arises from the reproducibility of the process. Since all parts of the configuration can be monitored and controlled by a control unit, the influence of personal on the mounting process can be reduced and the quality of adhesiveness of the adhesive layer can be improved.

While the device for exerting a pressure force on the surface of the polish head and the control unit can still be represented by an operator, these two ingredients are preferentially provided by some mechanics or logic, respectively. Additionally, an integration of the inventive configuration into a CMP-tool is possible as well.

The steps of applying a higher temperature by a device for heating and of applying a pressure force by a device for exerting a pressure force can be performed either at the same time in parallel or subsequently. However, the viscous, or liquid characteristics of the adhesive layer due to the heat should be present, when starting to apply the pressure force onto the backing film.

Another advantageous aspect involves using a roller for exerting the pressure force onto the backing film. In particular, the roller is efficient in removing the air bubbles between the adhesive layer and the polish head by leading the air bubbles to the edge of the backing film and by redistributing melted adhesive material below the backing film. The roller surface is preferably made of rubber or silicon, but any other material is possible as well. The roller is led by a roller guide, which is responsible for rolling the roller across the backing film thereby exerting a uniform pressure force at any location on the backing film.

In order to control the pressure force, the height of either the roller guide device or the device for holding the polish head can be adjusted relative to the plane defined by the backing film. In the case of the roller guide device being adjustable, a uniform pressure force at all locations on the backing can be guaranteed by preferably realizing two of them on each side of the roller. The adjustment unit of the device for holding the polish head also has to provide the characteristic, that the surface of the polish head, which has to be covered by the backing film, is essentially parallel to the axis of the roller. By providing such characteristics, the process of mounting a backing film to a polish head can be repeated with high coincidence and reproducibility even in the case of differing operators.

A further improvement is the aspect of connecting an energy source in the motor for moving the roller. This feature further reduces the need for skill and routine of the operators. Preferably an adjustable velocity electric motor is used.

In a further aspect, a plate is considered due to which the pressure force can be exerted upon the backing film. The surface of the plate is sufficiently planar and preferably has the size of the backing film. Once the polish head is mounted to the device for holding the polish head using the configuration of the present invention and the polish head is covered with the backing film, the plate can be released and the polish head or the plate can be moved into the direction of each other using a motor such that their respective surfaces are essentially parallel to each other. When they meet, they are acting on each other with a pressure force that presses the backing film and the adhesive layer onto the polish head. In order to impede a shearing movement of the backing film, the movement of the plate or the polish head and the pressure force are perpendicular to the surface of the polish head and the backing film.

In a further aspect, the heating of the backing film is considered. The device for exerting a pressure force, e.g. the roller or the plate, can be heated and by heat transport the heat can be transferred to the backing film and the adhesive layer. A sensor enables the operators to control the temperature, which on the one hand side should be constant during the mounting procedure and on the other hand should not increase beyond a threshold value in order to prevent damaging the, e.g., polyurethane backing film material.

In a further aspect, an additional sensor for measuring the pressure force is considered. Using e.g. a set of three sensors, the distribution of pressure force across the backing film can be measured and compared in order to guarantee a uniform process.

A complete process control is enabled in a further aspect. Utilizing a control unit in the mode of closed loop control, the motor, the device for heating, and the device for exerting a pressure force can be controlled to run in a self-regulating configuration. This aspect gives the advantage of full process monitoring, especially further quality improvement by correcting and adjusting parameters.

In a further aspect, the polish head as the source for the heat transferred to the backing film is considered. The advantage is, that the adhesive layer can be directly addressed by the heat instead of a heat transport via the backing film.

In a further aspect, a device for aligning the backing film, i.e. the perforation of the backing film, with the vacuum holes, which have to penetrate the backing film in order to contact the, e.g., semiconductor wafer, is considered. Such a device, when incorporated into the present configuration, accelerates the process of mounting the backing film, and therefore advantageously leads to a significant saving of time for manufacturing disklike objects, e.g. wafers.

Other features which are considered as characteristic for the invention are set forth in the appended claims.

Although the invention is illustrated and described herein as embodied in configuration and method for mounting a backing film to a polish head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
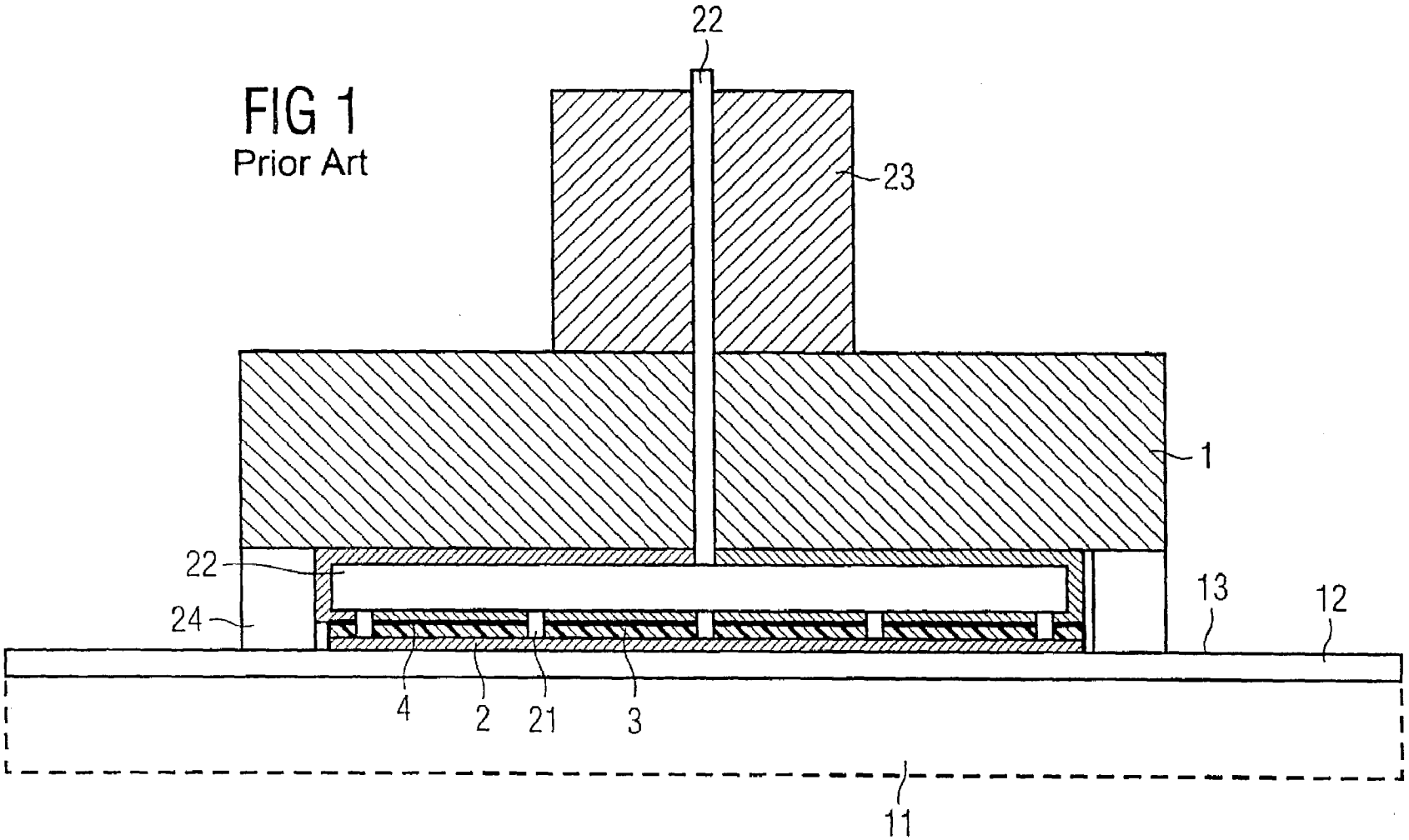
FIG 1 Prior Art
FIG. 1 is a cross sectional view of a polish head and a backing film during the process of chemical mechanical polishing.

Referring now to the figures of the drawing in detail and first, particularly, to FIG. 1. thereof, there is shown a prior art configuration of a polish head during polishing. The polish head 1 is connected to a polishing configuration via a connection piece 23 and is thereby rotated. Vacuum chambers 22 are used to hold the semiconductor wafer 2 prior to polishing by sucking the semiconductor wafer 2 to vacuum holes 21 distributed over the planar—or nearly planar—surface of polish head 1. In order to start the polishing, the polish head 1 is moved to the polishing table 11 that is covered by a polish pad 12 on which a slurry 13 is distributed containing abrasive and chemical additives. When a contact between the polish head 1 and the polish pad 12 has been established, the semiconductor wafer 2 is released from vacuum holes 21 such that there is a slight pressure from backing film 3 to the backside of semiconductor wafer 2. Floating retaining rings 24 protect the wafer edges from experiencing a particularly intensive removal of material. The backing film 3 is perforated in order to communicate with the vacuum holes 21 and has an adhesive layer 4 by which it is stuck to the polish head 1.

When polishing, the polish head 1 holds semiconductor wafer 2 with the help of the backing film 3, which serves for outweighing non-uniformities acting on semiconductor wafer 2 from the backside as well as from the frontside. Due to material fatigue and particle contamination, the backing film 3 has to be exchanged from time to time.

Figure 2:
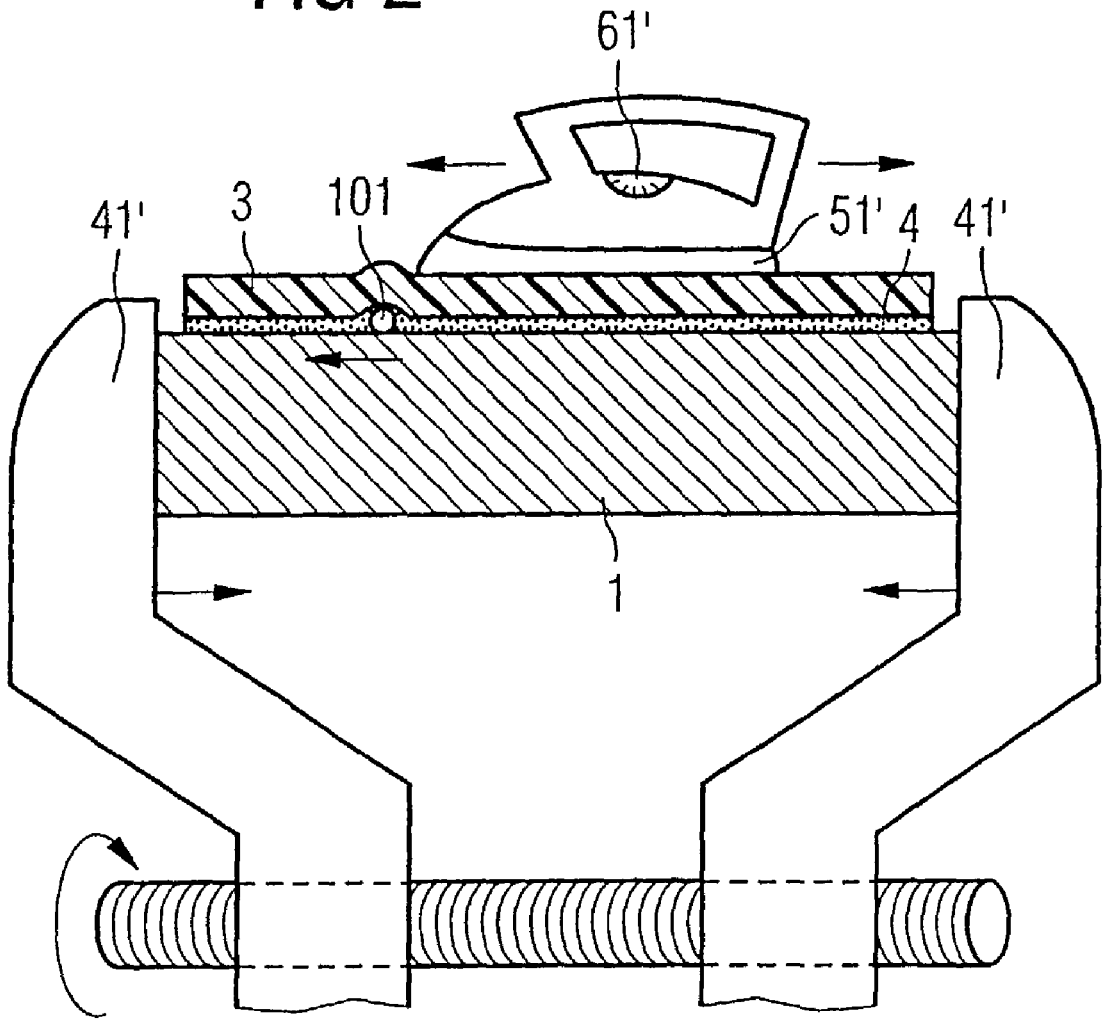
FIG. 2 is a side view of a first, simple embodiment of the invention, namely, a workbench and an iron handled and controlled by an operator.

Using a first simple embodiment, the method of the present invention will be now explained with reference to FIG. 2.

After polishing, i.e. no semiconductor wafer 2 is held by vacuum holes 21, the polish head 1 is unmounted from the connection piece 23 of the polishing configuration, and is clamped into a work bench 41'. The surface of the polish head 1 is positioned in order to receive the backing film 3 with the adhesive layer 4, e.g., on the topside. The operator then removes the backing film 3 including the adhesive layer 4 from a foil and puts it onto the surface of polish head 1. Thereby he aligns, the perforation of backing film 3 with the vacuum holes 21 of the polish head 1. In order to remove air bubbles 101, which are eventually enclosed between the adhesive layer 4 and the polish head 1, the operator takes an iron as both a device 51' for exerting a pressure force and a heating device 61' for heating and starts ironing the backing film 3. Selecting an appropriate temperature of the iron and waiting for a sufficient time such that a constant temperature is established, the adhesive layer 4 becomes viscous and the air bubble can be moved beneath the backing film 3 by exerting a pressure force on backing film 3. Moving the iron continuously across the surface, the air bubble 101 will eventually be pressed out of the adhesive layer 4. In this embodiment, the operator should try to insure that the heating device for heating, i.e. the iron, does not overheat backing film 3, and that the whole surface of backing film 3 is provided with a uniform pressure force.

Figure 3:
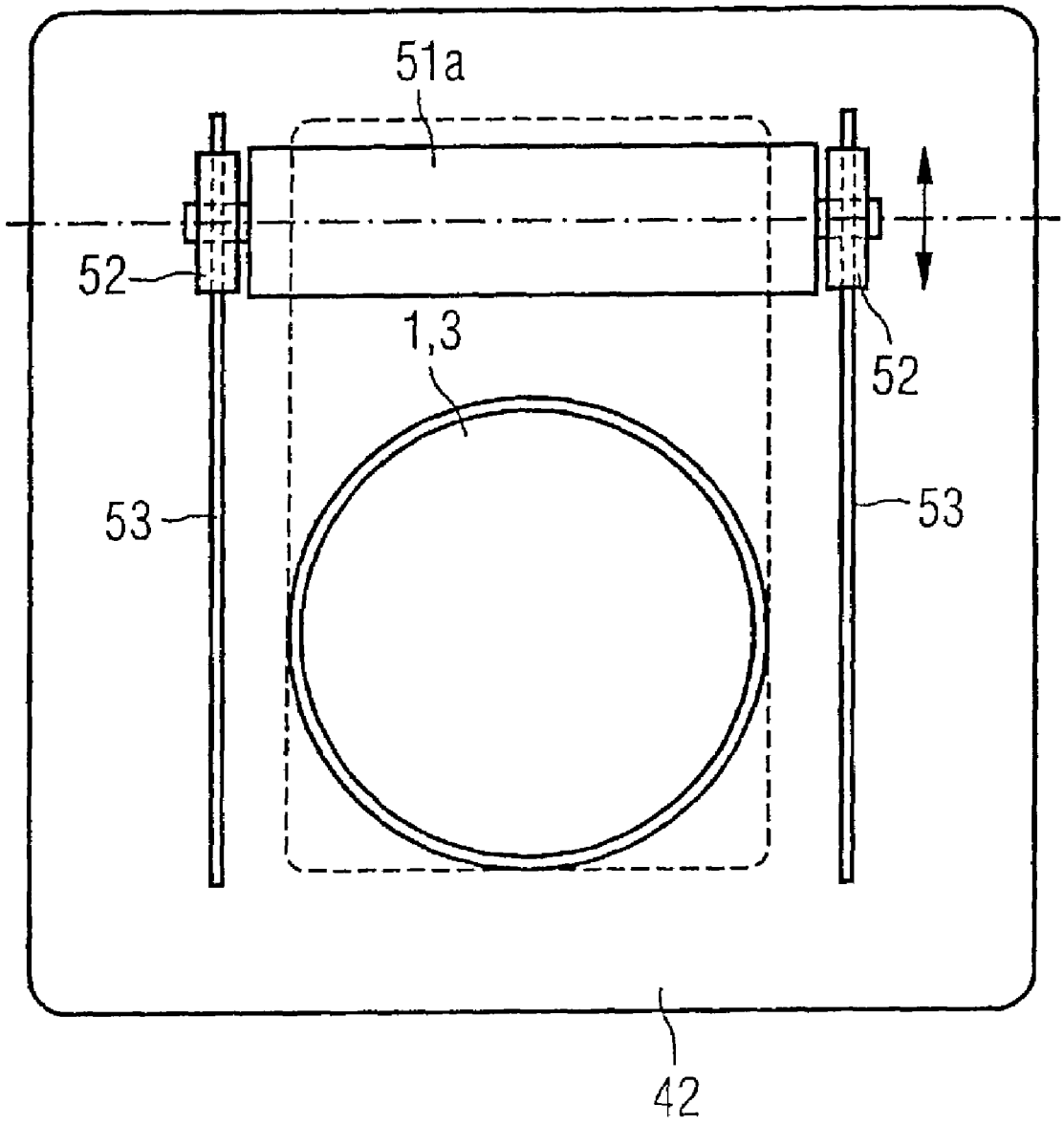
FIG. 3 is a top view of a second embodiment of the invention.

A second embodiment is illustrated in FIGS. 3 and 4, where the top and side views are respectively shown. The unmounted polish head 1 is held from underneath by a device 41 for holding a polish head 1. The surface of polish head 1, which has to a receive backing film 3 is positioned in about the same plane as it is stretched up by a guide rail system 53 carrying roller guides 52. These roller guides 52 lead a roller 51*a* serving as a device for exerting a pressure force across the playing stretched by the surface of polish head 1. The apparatus top plate 42 preferably is positioned in the same plane in order to protect the backing film edges when the roller starts to contact the surface of polish head 1.

Figure 4A:
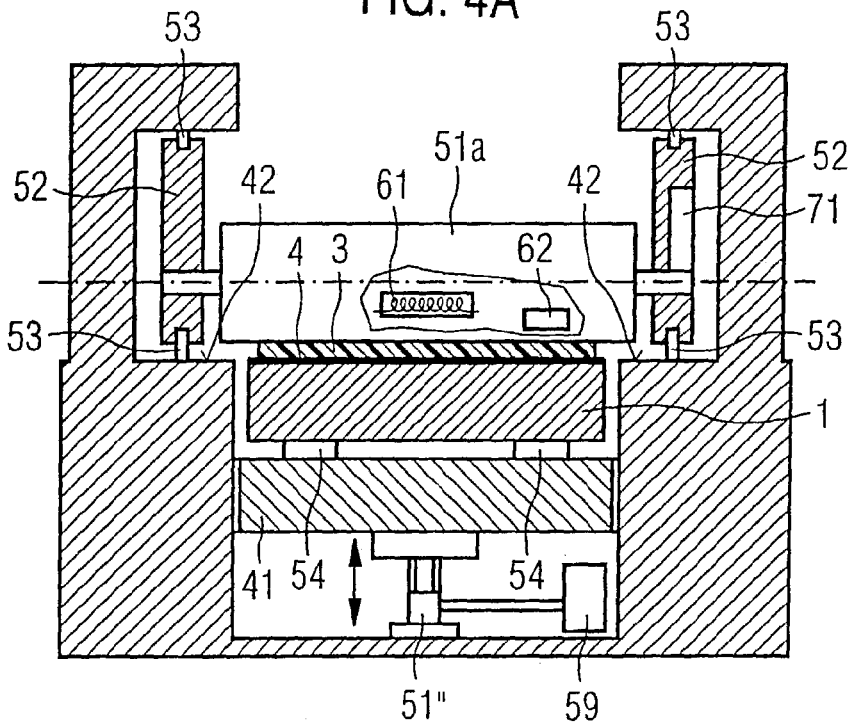
FIG. 4A is side view of the second embodiment of the invention.

When the backing film 3 is laid upon the polish head 1 such that perforations are aligned to the vacuum holes 21, the roller guides 52 start to move along guide rail 53 thereby rolling roller 51*a* across the apparatus top plate 42 and then across the surface of polish head 1 covered by backing film 3 with the adhesive layer 4 orientated towards the polish head 1. Roller guide 52 is driven by an electric motor 71 as can be seen in the sideview of FIG. 4A. While the roller 51*a* exerts the pressure force for ironing the backing film 3, the height of the device 41 for holding of the polish head 1 is adjustable by a pneumatic cylinder 51" in case the pressure force has to be varied. E.g., the polish head 1 can be lifted down in order to move roller 51*a* to a position above the center of the polish head 1, after which the polish head 1 can be raised again to the ironing level. Then, the process of ironing can be started by moving the roller 51*a* from the center position outwards in order to remove air bubbles 101 from beneath the adhesive layer 4.

In order to liquefy the adhesive layer for removing air bubbles 101 or material inhomogeneities, the roller 51*a* includes a device 61 for heating for heating the roller surface and thus the backing film. Corresponding rollers 51*a*, e.g. made from silicone or rubber, are generally available from specialized trade. Such rollers 51*a* are heatable up to 100° C., which is sufficient to melt or liquefy the adhesive layer 4.

Figure 4B:
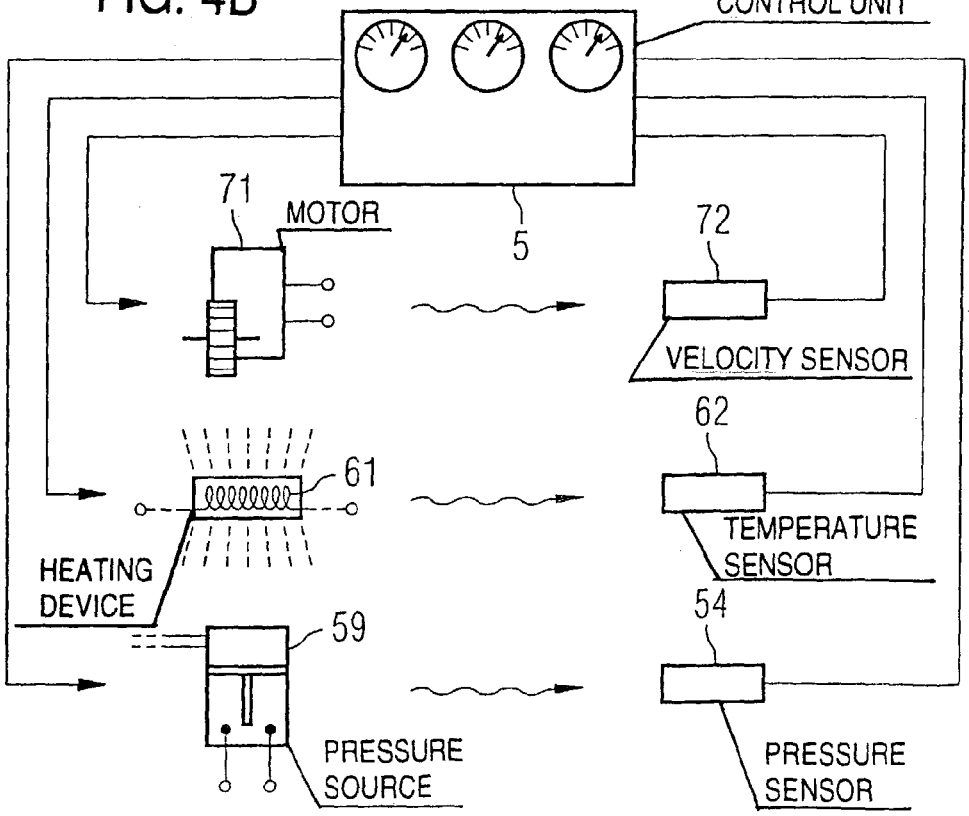
FIG. 4B is a diagrammatic view of the closed loop control circuit of the second embodiment of the invention.

While the height of the guide rail system is adjustable at 4 different locations in order to achieve a plane for the roller axis that is parallel to the surface of polish head 1, the strength of the uniform pressure force can be controlled by a source 59 for pressure that acts on the pneumatic cylinder 51". The pressure force that is actually exerted upon the backing film 3 is measured by sensors 54, or load cells, which are connected to a control unit 5, as can be seen in FIG. 4B. The pressure force is commonly maintained within a range of pressure values, which is controlled by the control unit 5. This is achieved by connecting the control unit 5 and the energy supply to the pressure source 59, which acts on the device for exerting a pressure force, i.e. the pneumatic cylinder 51". There is also a temperature measuring sensor 62 sending signals to the control unit 5 in order to maintain the heat transfer supplied by the device 61 for heating at a constant level or at least beneath a threshold value to prevent the backing film 3 from heat damage.

To exert a uniform pressure force by rolling the roller 51*a* across the backing film 3, the velocity of the roller guide driven by the electromotor 71 is also controlled by control unit 5, which receives signals from a velocity sensor 72. This sensor 72 can be replaced, if a tight relationship between energy supply by control unit 5 and the resulting roller guide velocity is known.

Figure 5:
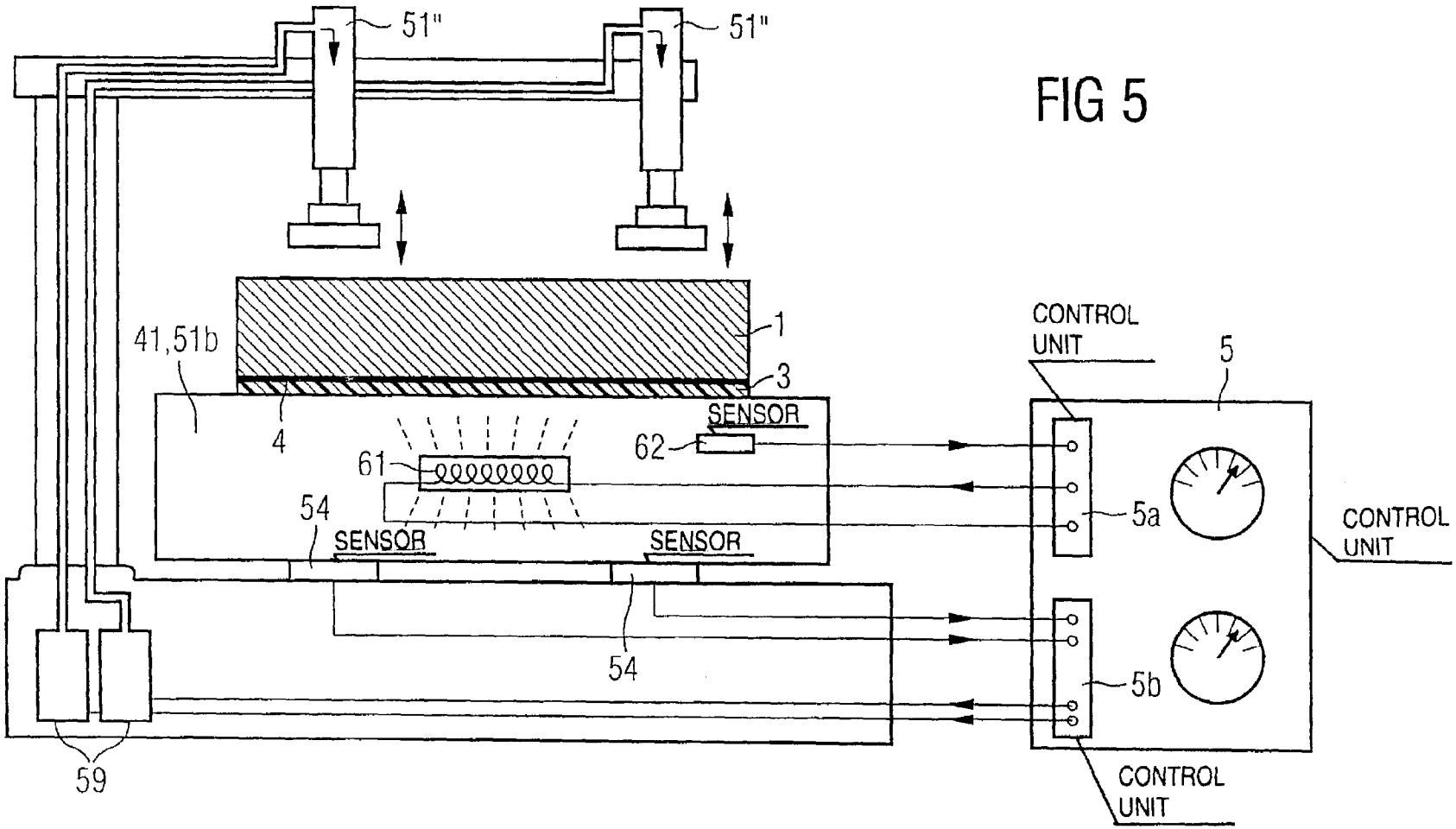
FIG. 5 is a side view of a third embodiment of the invention.

A third embodiment of the method and apparatus is shown in FIG. 5, where the polish head 1, which has its surface directed to the bottom, is pressed onto the device 41 for holding the polish head 1. The device 41 is a plate. The backing film 3 is positioned between the polish head 1 and the device 41 and the adhesive layer 4 contacts the surface of polish head 1. The pressure force is exerted by pneumatic cylinders 51 that press the polish head 1 down onto the plate. Multiple pneumatic cylinders 51 are used as a device for exerting a pressure force. Each of the pneumatic cylinders 51 is supplied with pressure by separate sources for pressure 59, because the pressure force acting on the polish head 1 can then be balanced in order to exert a uniform pressure force. To accomplish this, multiple sensors 54 are installed beneath the device 41 for holding the polish head 1 in order to measure the distribution of pressure force across the polish head 1. From these elements a closed loop control circuit is established by a control unit 5*b*.

The device 41 for holding the polish head 1, i.e. the plate, includes a heating device 61 for heating the backing film 3 and the adhesive layer 4, and includes a sensor 62. The heating device 61 and the sensor 62 are controlled by the control unit 5*a*. If the heat transferred to the backing film 4 increases the temperature measured by the sensor 62 beyond a maximum threshold value, the control unit 5*a* reduces the energy supply to the heating device 61 for heating and the temperature decreases again.

Figure 6:
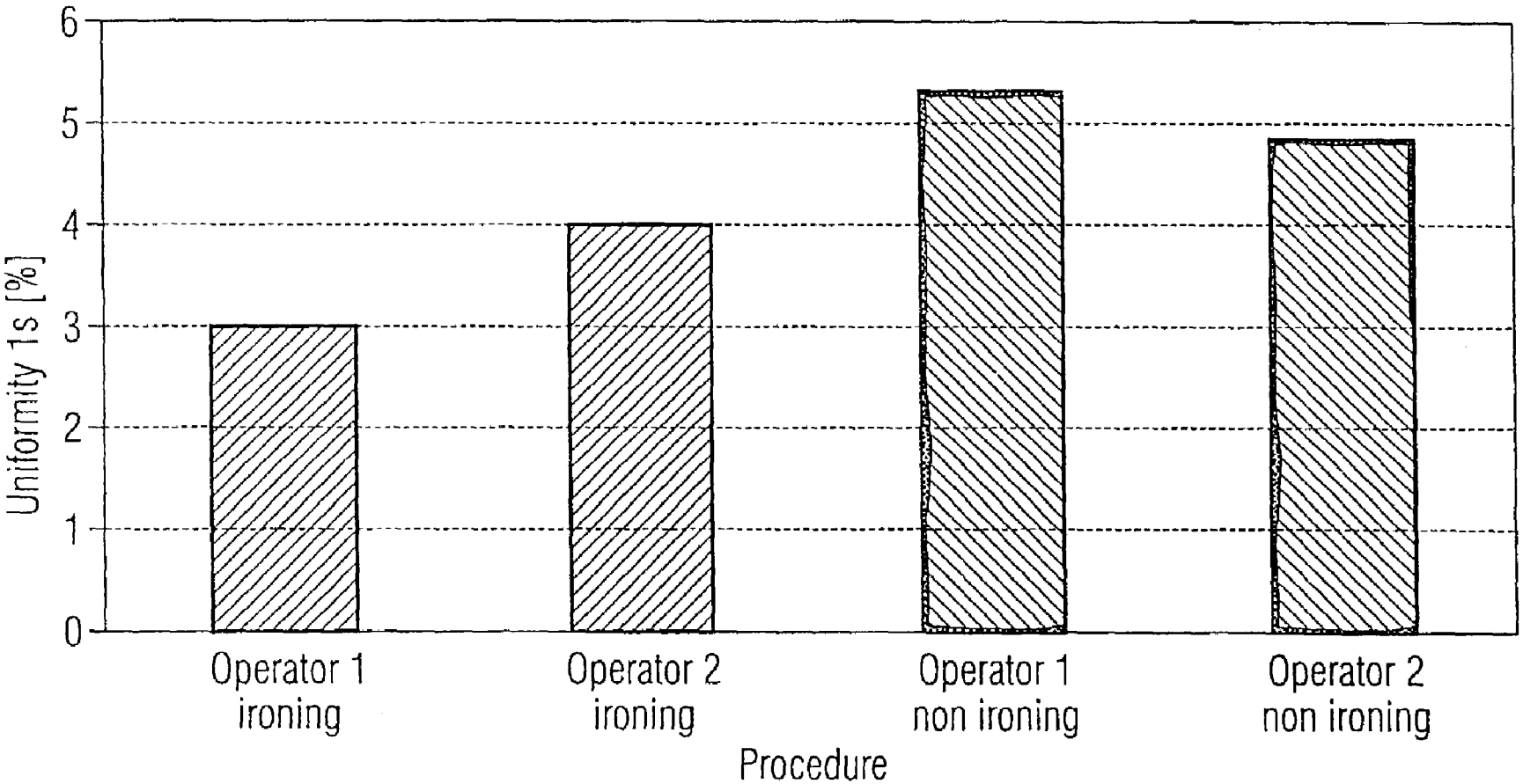
FIG. 6 is a graph showing the results of an experiment to verify uniformity after chemical mechanical polishing using different backing film mounting procedures.

These embodiments provide a way to remove the air bubbles 101 and the inhomogeneities of the adhesive layer 4 for mounting backing films 3. Therefore, using this method and apparatus the uniformity value will significantly be reduced, which is shown in FIG. 6. There, the thickness uniformity has been monitored for two different operators, which carried out several mounting processes either using the ironing procedure, i.e. the first embodiment described above, or the conventional procedure for mounting the backing film 3 manually without heating. The 1-σ-uniformity value expressed in percent of total thickness reaches a value of 5.1% for the conventional mounting mode, and a value of 3.5% for mounting the backing film 3 with the iron. Using the full advantage of the method and apparatus according to the second and third embodiments of the present invention, an even stronger reduction in uniformity can be expected. Such a reduction in uniformity ranges directly leads to a significant increase in semiconductor wafer yield and quality.

We claim:

1. A method for mounting a backing film having an adhesive layer, the method which comprises:

providing a polish head having a surface for contacting the backing film, the surface of the polish head formed with vacuum holes;

holding the polish head;

aligning the backing film to the vacuum holes formed in the polish head;

covering the surface of the polish head with the backing film;

heating the backing film, while holding a heating temperature substantially constant or below a threshold value using a control unit and a temperature measuring sensor; and exerting a uniform pressure force on the backing film perpendicular to the surface of the polish head, with a device moveable relative to the surface of the polish head.

2. The method according to claim 1, which comprises performing the step of exerting the uniform pressure force by rolling a roller across the surface of the polish head covered by the backing film.

3. The method according to claim 2, which comprises measuring a temperature of the roller and adjusting the heating temperature in response to a signal from the temperature measuring sensor.

4. The method according to claim 2, which comprises when performing the step of covering the surface of the polish head with the backing film, measuring a pressure force exerted on the surface of the polish head and adjusting the pressure force in response to a signal from a sensor for measuring the pressure force.

5. The method according to claim 1, which comprises performing the step of exerting the uniform pressure force by pressing a plate onto the surface of polish head covered by the backing film.

6. The method according to claim 5, which comprises measuring a temperature of the plate and adjusting the heating temperature in response to a signal from the temperature measuring sensor.

7. A configuration for mounting a backing film having an adhesive layer, the configuration comprising:

a device for holding polish head having a surface formed with a plurality of vacuum holes;

a device for aligning the hacking film to the vacuum holes formed in the polish head;

a pressure exerting device for exerting a uniform pressure force on the surface of the polish head when the surface of the polish head is being covered by the backing film;

a device for heating the backing film;

said pressure exerting device including a roller having an axis parallel to the surface of the polish head; and said pressure exerting device including a roller guide for guiding said roller parallel to the surface of the polish head when the polish head is held by the device for holding the polish head.

8. The configuration according to claim 1, wherein at least one component selected from a group consisting of said roller guide and said device for holding the polish head includes a device for adjusting a distance between the axis of said roller and the surface of the polish head.

9. The configuration according to claim 1, further comprising:

an energy source and a motor for moving said roller;

said motor connected to said roller guide.

10. The configuration according to claim 1, wherein the polish head is configured for polishing semiconductor wafers.

11. The configuration according to claim 1, wherein:

said device for heating is configured for heating said pressure exerting device for melting the adhesive layer; and said pressure exerting device includes at least one sensor for measuring a temperature.

12. The configuration according to claim 11, further comprising a control unit connected to at least one component selected from a group consisting of said sensor for measuring the temperature, said device for heating, and said pressure exerting device.

13. The configuration according to claim 1, wherein at least one component selected from a group consisting of said device for holding the polish head and said pressure exerting device includes at least one sensor for measuring a pressure force exerted on the surface of the polish head being covered by the backing film.

14. The configuration according to claim 13, further comprising a control unit connected to at least one component selected from a group consisting of said sensor for measuring the temperature, said device for heating, said sensor for measuring the pressure force, and said pressure exerting device.

15. A configuration according to claim 1, wherein said device for heating is configured for heating the polish head.

16. A configuration for mounting a backing film having an adhesive layer, the configuration comprising:

a device for holding a polish head having a surface formed with a plurality of vacuum holes;

a device for aligning the backing film to the vacuum holes formed in the polish head;

a pressure exerting device for exerting a uniform pressure force on the surface of the polish head when the surface of the polish head is being covered by the backing film;

a device for heating the backing film;

said pressure exerting device including a plate having a surface parallel to the surface of the polish head; and said pressure exerting device being moveable relative to the surface of the polish head.

17. The configuration according to claim 12, wherein:

said device for heating is configured for heating said pressure exerting device for melting the adhesive layer; and said pressure exerting device includes at least one sensor for measuring a temperature.

18. The configuration according to claim 16, further comprising a control unit connected to at least one component selected from a group consisting of said sensor for measuring the temperature, said device for heating, and said pressure exerting device.

19. The configuration according to claim 16, wherein at least one component selected from a group consisting of said device for holding the polish head and said pressure exerting device includes at least one sensor for measuring a pressure force exerted on the surface of the polish head being covered by the backing film.

20. The configuration according to claim 19, further comprising a control unit connected to at least one component selected from a group consisting of said sensor for measuring the temperature, said device for heating, said sensor for measuring the pressure force, and said pressure exerting device.

21. A configuration according to claim 16, wherein said device for heating is configured for heating the polish head.

22. The configuration according to claim 16, wherein the polish head is configured for polishing semiconductor wafers.

* * * * *